US005584430A

United States Patent [19]

Mulry

[11] Patent Number: 5,584,430

[45] Date of Patent: Dec. 17, 1996

[54] FLIP-TOP CONTAINER WITH INTEGRAL HANDLES

[75] Inventor: Patrick E. Mulry, Grand Rapids, Mich.

[73] Assignee: Amway Corporation, Ada, Mich.

[21] Appl. No.: 616,820

[22] Filed: Mar. 15, 1996

[51] Int. Cl.[6] ..... B65D 5/468; B65D 5/56; B65D 5/66

[52] U.S. Cl. ..... 229/117.16; 220/416; 229/117.13; 229/225

[58] Field of Search ..... 229/117.13, 117.16, 229/145, 225; 220/416, 418, 462

[56] References Cited

U.S. PATENT DOCUMENTS

| | | | |
|---|---|---|---|
| D. 329,199 | 9/1992 | Corso . | |
| D. 350,480 | 9/1994 | Sutherland . | |
| D. 352,453 | 11/1994 | Bacchetti et al. . | |
| D. 356,253 | 3/1995 | Bacchetti et al. . | |
| D. 364,087 | 11/1995 | Farley . | |
| 1,965,503 | 7/1934 | Lowman | 229/117.13 |
| 2,019,307 | 10/1935 | Hill et al. | 229/117.16 |
| 2,069,997 | 2/1937 | Carr | 229/117.13 |
| 2,312,598 | 3/1943 | Sprague | 229/117.16 |
| 3,119,544 | 1/1964 | Cope et al. . | |
| 4,169,539 | 10/1979 | Price . | |
| 4,447,004 | 5/1984 | House et al. . | |
| 4,974,771 | 12/1990 | Lavery | 229/117.13 |
| 5,238,179 | 8/1993 | Hart . | |
| 5,277,359 | 1/1994 | Lindsay | 220/416 |
| 5,320,279 | 6/1994 | Giblin et al. . | |
| 5,344,066 | 9/1994 | Fogle | 220/416 |
| 5,373,960 | 12/1994 | Gunn et al. . | |
| 5,437,407 | 8/1995 | Kim . | |
| 5,497,899 | 3/1996 | Wuerfel | 229/117.13 |

*Primary Examiner*—Gary E. Elkins
*Attorney, Agent, or Firm*—Warner Norcross & Judd

[57] ABSTRACT

A flip-top paperboard container with (a) a bowling-grip-type handle in the top wall for removing individual containers from multiple container shipping cases and for carrying the container before it is opened, and (b) a side handle in the rear wall for carrying the container after it is opened. The bowling grip handle includes a finger opening and a thumb opening. The thumb opening is located toward the rear of the top wall so that, when desired, the side handle and thumb opening can be grasped simultaneously by a single hand.

10 Claims, 4 Drawing Sheets

FLIP-TOP CONTAINER WITH INTEGRAL HANDLES

BACKGROUND OF THE INVENTION

The present invention relates to a container manufactured from paperboard, and more particularly to a reclosable paperboard container having a hinged flip-top lid.

Paperboard containers or cartons are used for containing a wide variety of products, including granular and powder materials such as laundry detergents. In some applications, the container is opened and its contents are used immediately leaving an empty container to discard. In other applications, however, the contents of the container are used gradually by the consumer. For example, with laundry detergent, the consumer uses only a small portion of the detergent with each load of laundry. As a result, it is desirable for the container to be adapted for storage and for repeated opening and closing. A variety of reclosable flip-top containers have been developed to meet this need.

A particularly popular method for manufacturing reclosable flip-top containers is to form the container with a tear strip that is removed to form a flip-top lid from the top portion of the container. Generally, the tear strip extends across an upper portion of three walls of the container. To open the container, the tear strip is removed so that the top wall of the container and the top portion of three side walls of the container form a reclosable flip-top lid. The lid remains attached to the container along the unbroken fourth wall. The fourth wall can be scored to function as a hinge for the lid. Alternatively, the fold line between the fourth wall and the top wall can function as the hinge. Often, a liner is fitted inside the container to reinforce the container and to provide a lip for receiving the closed lid.

Containers used for storing heavy granular and powder materials are typically manufactured from a relatively heavy stock of paperboard. The stock is cut and scored to form a "blank" that is glued and folded into the final container. The liner is often separately manufactured from a lighter stock paperboard and secured within the container by conventional adhesives.

A variety of different handle arrangements for lifting and carrying have been incorporated into conventional flip-top containers. Some containers include a strap handle that is separately manufactured and attached to the container by rivets, bayonet-type arrangements, or other conventional techniques. These handles are costly to manufacture and install and can separate from the container under heavy use. In addition, these handles, straps, and rivets are difficult to remove and hinder the recycling process.

Other containers are provided with handle-openings that are die cut into the blank during manufacture. For example, U.S. Pat. No. 4,447,004 issued on May 8, 1984 to House et al includes a bowling-grip type handle die cut into the top wall of the container. The handle includes adjacent finger and thumb openings that can be grasped simultaneously with a single hand. This handle is useful in carrying and transporting an unopened container, and provides a relatively comfortable grip that evenly supports the container. Also, because it is formed in the top wall, this handle facilitates removal of the container from multiple container shipping cases. However, this handle is not well-suited for a flip-top container because lifting the top of the container after opening simply pulls the lid open possibly damaging the lid and container. Another example, U.S. Pat. No. 4,169,539 issued on Oct. 2, 1979 to Price discloses a single handle opening die cut into a side wall of the container. While a side handle can be used with a flip-top container without causing the lid to open, it is less comfortable than the bowling-grip handle. A side handle is also difficult to access when the cartons are closely packed in a case for shipping.

SUMMARY OF THE INVENTION

The aforementioned problems are overcome by the present invention which provides a flip-top container having a bowling-grip-type handle in the top wall of the container and a side handle in the rear wall of the container. The side handle is positioned near the thumb opening in the bowling grip handle so that the side handle and thumb grip can be grasped together if desired.

The present invention provides a simple and effective handle arrangement that provides (a) a bowling-grip handle for easily removing the individual container from a multiple container shipping case and for carrying the container before it is opened, and (b) a side handle for carrying the container after it is opened. The side handle can also be grasped in conjunction the thumb opening of the bowling-grip handle. When grasped in this manner, the user's fingers can be used to support the weight of the container and the user's thumb can be used to prevent the flip-top lid from opening. Also, when grasped in this manner, the user's thumb can be used to hinge open the flip-top lid. This leaves the user's second hand free to scoop material from the container.

Additionally, the handles are easily die cut into the container eliminating the need and expense of manufacturing and installing a separate handle or strap. Further, the integral handle openings facilitate the container manufacturing, disposal, and recycling process.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
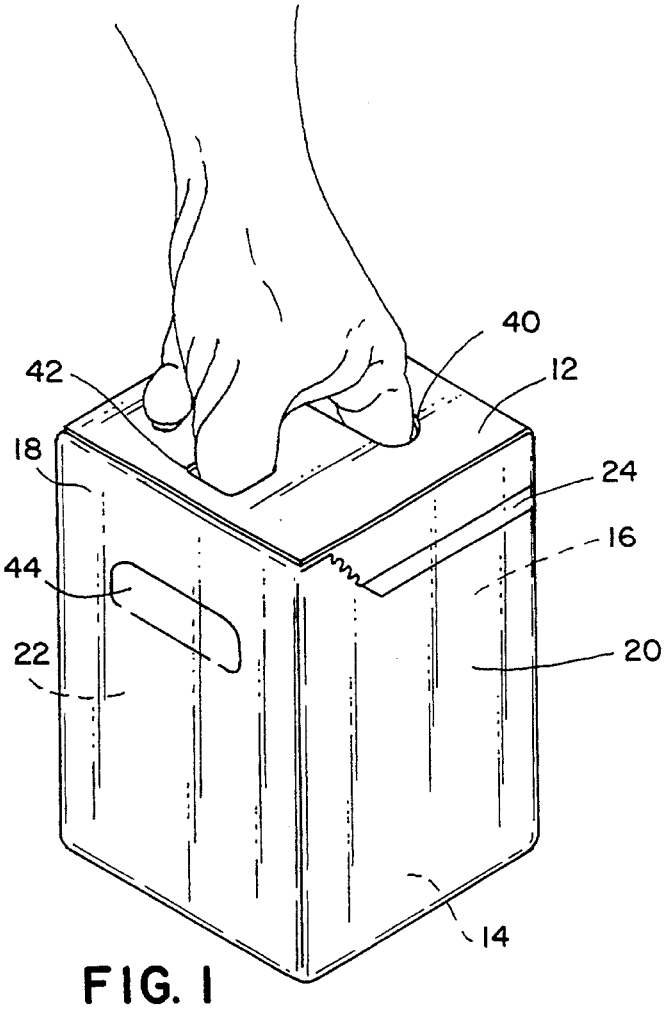
FIG. 1 is a perspective view of the container before the tear strip is removed.
Figure 2:
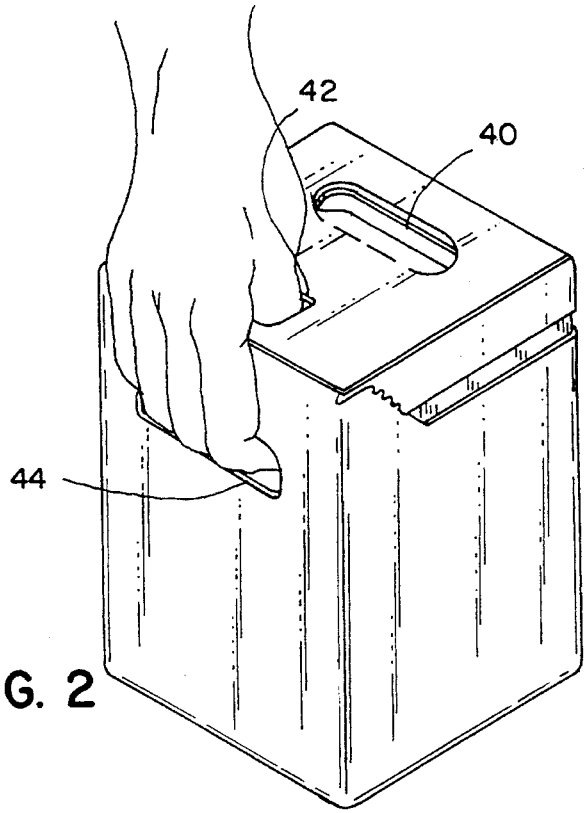
FIG. 2 is a perspective view of the container after the tear strip is removed.
Figure 3:
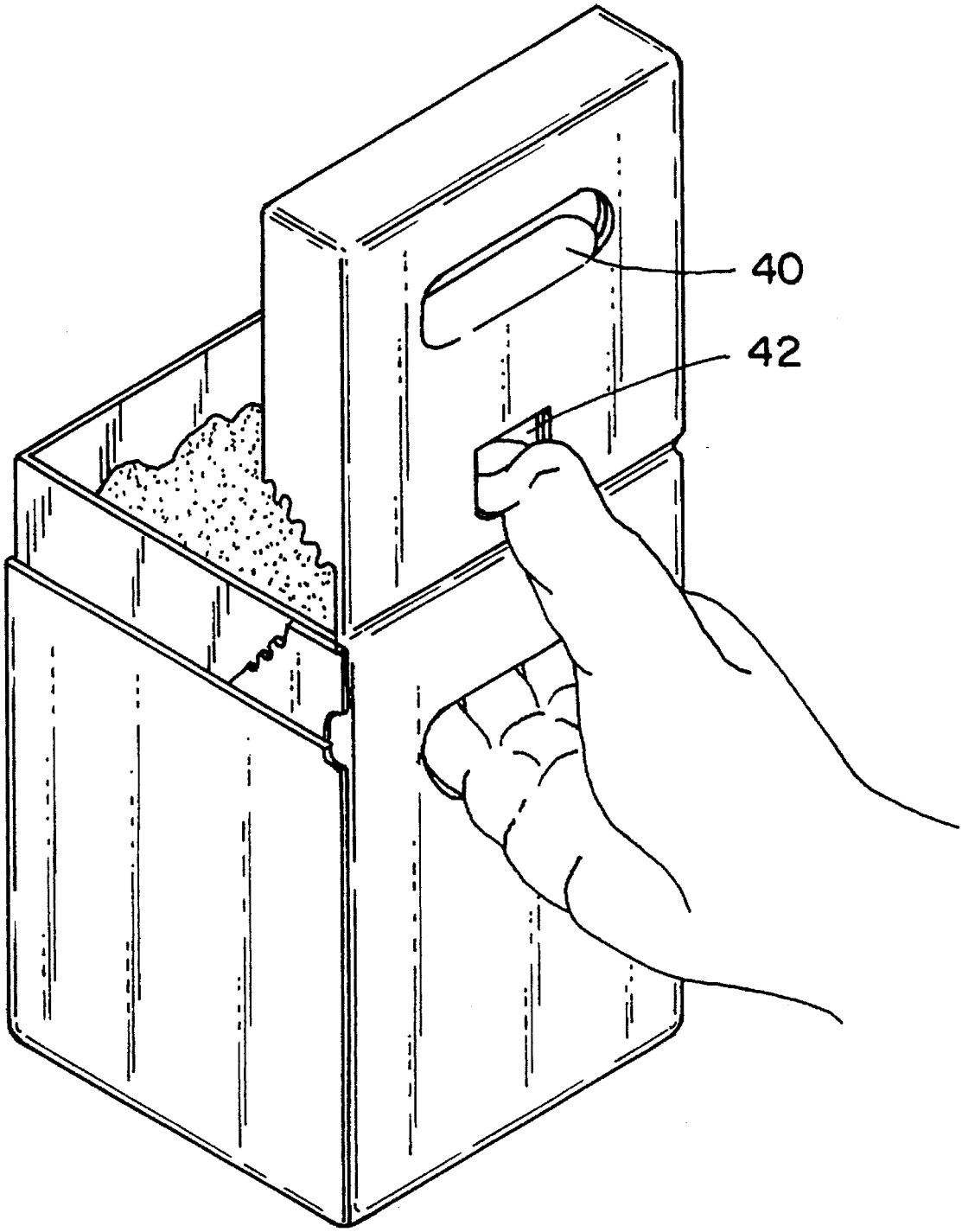
FIG. 3 is a perspective view of the container with the lid open.

A container according to a preferred embodiment of the present invention is illustrated in FIGS. 1–3 and generally designated 10. The present invention is described in connection with a conventional tear strip paperboard canon. However, it is well-suited for use with other flip-top containers. The container 10 is a generally rectangular box defining a space for containing a material. Powder and granular material are contained within a bag that is placed inside the container. The bag prevents the contents from seeping out the handle openings, prevents the contents from leaching into the paperboard, and provides air-tight storage for the material. A tear strip 24 extends around a portion of the container 10 and can be removed to form a lid 26 that is hingedly secured to the container 10 at fold line 28 (See FIG.

2). The lid 26 can be opened as shown in FIG. 3 to permit access to the contents of the container 10. The container 10 also includes a conventional liner 28 fitted within the container 10 for reinforcing the container 10 and providing a lip 30 for receiving the lid 26.

The container 10 defines a top finger handle 40, a thumb handle 42, and a side finger handle 44. Top finger handle 40 and thumb handle 42 define a bowling-grip handle that can be used to carry the container before the tear strip 24 is removed. Side finger handle 44 and, if desired, thumb handle 42 are used to carry the container 10 and hold down the lid 26 after tear strip 24 is removed. Thumb handle opening 42 can also be manipulated by the user's thumb to open the lid 26 with that same hand that is supporting the container 10 by side finger handle 44.

Figure 4:
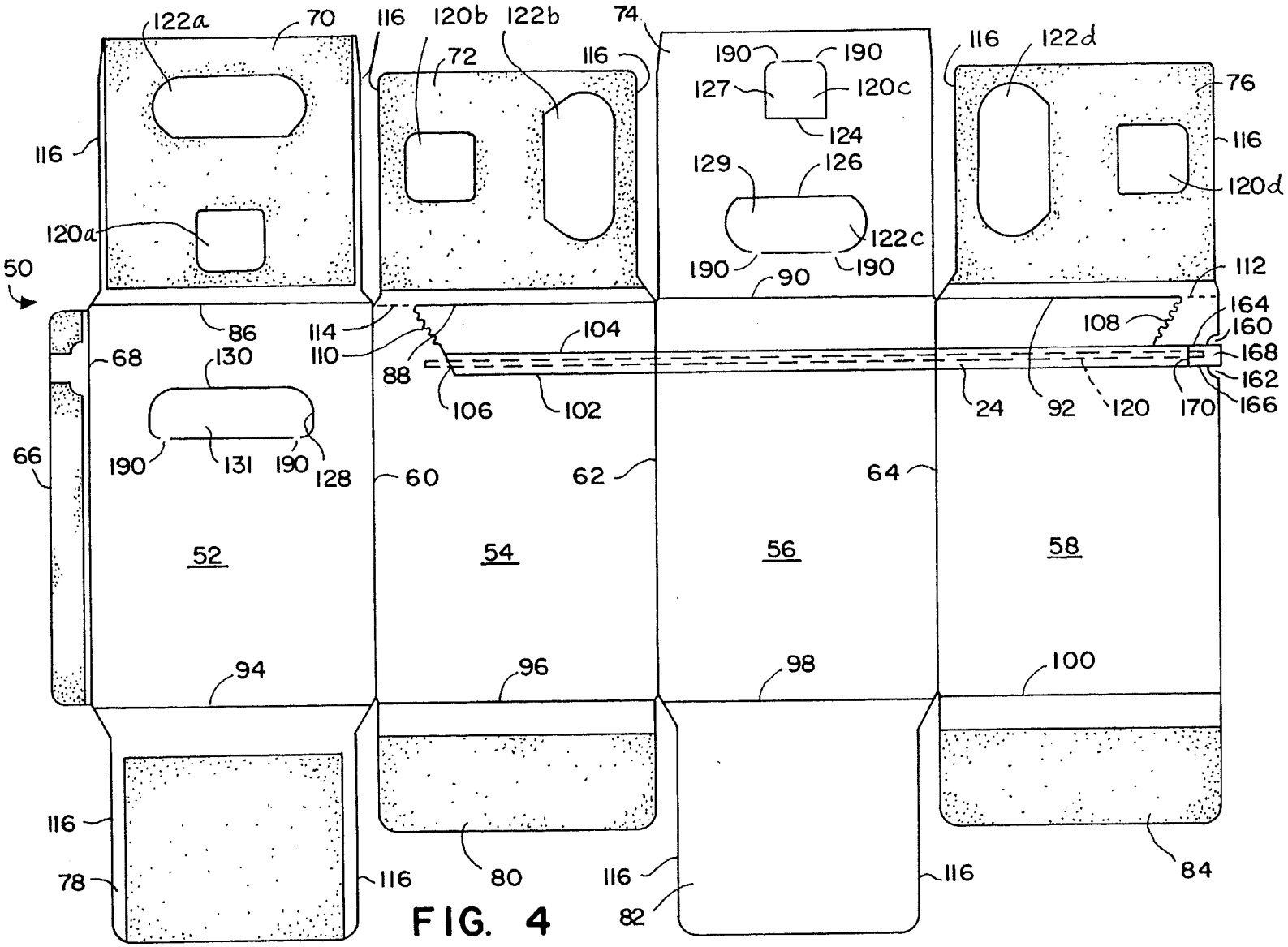
FIG. 4 is a top plan view of the blank for the container.

The container 10 is a rectilinear box including top wall 12, bottom wall 14, front wall 16, rear wall 18, and opposed side walls 20 and 22. The walls of the container 10 cooperate to define a space for containing material. FIG. 4 shows a paperboard container blank 50 that is cut and scored using conventional methods and apparatus. The container blank 50 includes four major panels 52, 54, 56, and 58 that are separated from each other by score lines 60, 62 and 64. The container blank 50 also include a narrow glue flap 66 separated from panel 52 by score line 68. The glue flap 66 is used to intersecure panels 52 and 58. The container blank 50 further includes top end flaps and bottom end flaps extending from each major panel. Top end flaps 70, 72, 74, and 76 are separated from major panels 52, 54, 56, and 58 by score lines 86, 88, 90, and 92, respectively. Similarly, bottom end flaps 78, 80, 82, and 84 are separated from major panels 52, 54, 56, and 58 by score lines 94, 96, 98, and 100, respectively. Opposite edges of end flaps 70, 72, 76, 78, and 82 include conventional gullets 116 which facilitate folding of the end flaps by helping to prevent the flaps from interfering with each other during the folding process.

The container 10 includes a tear strip 24 for separating the lid 26 from the main body of the container 10. The tear strip 24 is defined in panels 54, 56, and 58 by cut-score lines 102 and 104 which extend along opposite sides of conventional tear tape 120 (shown in hidden lines). Cut-score lines 102 and 104 are formed by cutting partially through the container blank 50. Cut line 106 terminates the tear strip 24 and extends entirely through the container blank 50 as well as the tear tape 120. A pair of angled, wave-cut perforated lines 108 and 110 extend upwardly from the tear strip 24 to score lines 92 and 88, respectively. A perforated line 112 extends between perforated line 108 and the free edge of panel 58. Likewise, a perforated line 114 extends between perforated line 110 and score line 60. The lid 26 separates from the main body of the container 10 along perforated lines 108, 110, 112, and 114 when the lid 26 is hinged open for the first time. The beginning end of the tear strip 24 is specially adapted to form a tab 168 that facilitates removal of the strip 24. A short cut 164 and 166 is form entirely through the container blank 50 along cut-score lines 102 and 104 at the beginning of the tear strip 24. A score line 170 is formed transversely across the tear strip 24 at the end of cuts 164 and 166 to allow the tab 168 to fold out from the container 10. Additionally, a pair of notches 160 and 162 are defined in the free edge of panel 58 above and below the tab 168 to make it easier to grab tab 168.

The container blank 50 defines a plurality of holes in top end flaps 70, 72, 74, and 76 which cooperate to form top finger handle 40 and thumb handle 42. Each of the top end flaps includes a thumb hole 120*a–d* and finger hole 122*a–d*. Each thumb hole 120*a–d* is generally square with rounded corners. The thumb holes 120*a–d* cooperate to define a thumb handle just large enough to accommodate a single thumb. Each finger hole 122*a–d* is generally rectangular with rounded comers. The finger holes 122*a–d* cooperate to define a top finger handle that is of sufficient size to accommodate multiple fingers. The thumb holes 120*a–d* and finger holes 122*a–d* are positioned to align when the top end flaps 70, 72, 74, and 76 are folded to form the top wall of the container 10. The stock is removed from the center of the holes in end flaps 70, 72, and 76. However, because top end flap 74 forms the outer panel of the top wall 12 and because it is desirable for the top finger handle 40 and thumb handle 42 to remain closed until opened by the consumer, only three edges of holes 120*c* and 122*c* are cut. This leaves a center flap 127 and 129 within holes 120*c* and 122*c*. Score lines 124 and 126 are formed along the uncut edge of each center flap 127 and 129 to the center flaps 127 and 129 to fold easily into the container 10. The container blank 50 further defines a single hole 128 in panel 52 which forms side finger handle 44. Hole 128 is generally rectangular with rounded comers and defines a side finger handle of sufficient size to accommodate multiple fingers. Only three edges of the hole 128 are cut leaving a center flap 131. A score line 130 is formed along the uncut edge of the center flap 131 allowing the center flap 131 to fold easily into the container 10. Bridge segments 190 can be defined around the center flaps 127, 129, and 131 to hold the center flaps in a closed position until segments 190 are ruptured.

Figure 5:
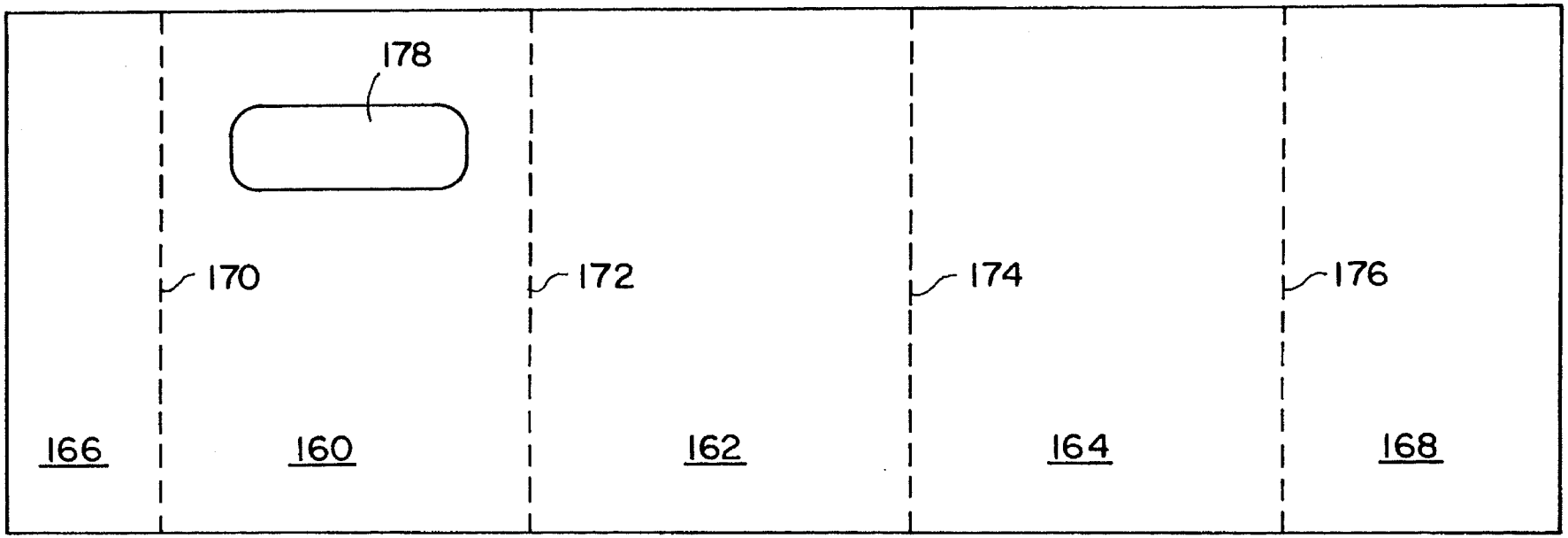
FIG. 5 is a top plan view of the blank for the liner.

Referring now to FIG. 5, the liner 28 is generally conventional and is manufactured from a liner blank 158. The liner blank 158 includes three major panels 160, 162, and 164 and two minor panels 166 and 168. Three walls of the liner are defined by the major panels while the fourth wall is defined by partially overlapping and interconnecting the minor panels 166 and 168. Adjacent panels are separated from each other by perforated cuts 170, 172, 174, and 176 which define a fold line between adjacent panels. The liner panels 160, 162, and 164 are slightly smaller in width and height than the corresponding container blank panels 54, 56 and 58, respectively, so that the liner will fit inside the container blank 50 when it is formed into a box. Similarly, partially overlapping liner panels 166 and 168 are slightly smaller in width and height than corresponding container blank panel 52. Panel 64 extends along the rear wall 18 of the container and includes an opening 178 which aligns with hole 128 when the liner 28 is fitted within the container blank. This opening 178 allows the center portion 131 to fold into the container 10.

Manufacture and Assembly

The container 10 is manufactured by separately forming the container blank 50 and liner blank 158 from the appropriate stock of paperboard. Typically, the container blank 50 is manufactured from a relatively heavy stock of paperboard. The surface of the paperboard can be finished as desired. The liner blank 158 is manufactured from a relatively light stock of unfinished paperboard. Once the container blank 50 is are cut, scored, and perforated using conventional die cutting apparatus, tear tape 120 is adhesively secured to the rear surface of tear strip 24. The container blank 50 is formed into a collapsed sleeve by securing glue flap 66 to panel 58 using conventional adhesives. Likewise, the liner blank 128 is formed into a collapsed sleeve by partially overlapping and securing minor panels 166 and 168 using conventional adhesives. The collapsed liner blank 158 is secured within the collapsed container blank 50 using conventional adhesives.

The interconnected container blank 50 and liner blank 158 are opened to create a rectangular sleeve. The bottom of the sleeve is closed by folding inwardly and adhesively securing the bottom end flaps 78, 80, 82, and 84. At this time, the top of the container 10 is left open to facilitate filling of the container 10.

A plastic bag (not shown) is provided and filled with the desired material using conventional filling apparatus. After filling, the bag is closed and sealed using conventional techniques and apparatus to contain the material in an airtight environment. The filled and sealed bag is then inserted into the container 10 through the open top end, and the top end flaps 70, 72, 74, and 76 are folded in and adhesively secured to close the top of the container 10. Alternatively, the bag is inserted into the container 10 before it is filled. The empty bag is then filled and sealed while in the container 10.

To lift the unopened container 10, pressure is applied to center flaps 127 and 129 until bridge sections 190 are ruptured and the center flaps 127 and 129 fold down into the container 10. As shown in FIG. 1, the container 10 is lifted by placing the user's fingers in top finger handle 40 and thumb in thumb handle 42. The container 10 is opened by grabbing tab 168 and peeling tear strip 24 away from the container 10. Cut line 106 ensures that the tear strip 24 tears cleanly from the container 10 at its terminating end. Removal of the tear strip 24 separates lid 26 from the main body of the container 10. The lid 26 remains hingedly attached to the container along score line 86. When the lid 26 is opened for the first time, perforated lines 108, 110, 112, and 114 are ruptured to provide a clean break between the lid and the side walls of the container. After tear strip 24 is removed, the container 10 is carried using side finger handle 44. The side finger handle is opened by pushing in on center flap 13 1 until the bridge sections 190 are ruptured and the center flap 131 folds into the container 10. The user may also use the thumb handle 42 in conjunction with the side finger handle 44. This allows the container 10 to be supported and the lid 26 manipulated by a single hand. For example, the user's fingers can be placed in side finger handle 44 to support the container 10 and the user's thumb can be placed in thumb handle 42 to lift, lower, and hold down the lid 26.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A reclosable flip-top container comprising:

a main body portion having a bottom wall, a pair of opposed side walls, a front wall and a rear wall, said rear wall having top and bottom edges;

a lid portion having a top wall with a front edge and a rear edge, said lid portion being hingeally connected to said main body portion along said rear edge;

said top wall of said lid portion defining a top finger handle of sufficient size to accommodate multiple fingers, said top finger handle being spaced inwardly from and extending parallel to said front edge;

said top wall of said lid portion further defining a thumb handle of sufficient size to accommodate a single thumb, said thumb handle disposed between said rear edge and said finger opening; and said rear wall defining a side finger handle, said side finger handle being of sufficient size to accommodate multiple fingers, said side finger handle being spaced below and extending parallel to said top edge of said rear wall, wherein said side finger handle and said thumb handle can be grasped simultaneously by a single hand.

2. The container of claim 1 wherein each of said opposing side walls and said front wall includes a top edge, said top wall being defined by overlapping end flaps extending from said top edge of each of said opposing side walls, said front wall and said rear wall, each of said end flaps including a finger hole and a thumb hole, said finger hole and said thumb hole of each of said end flaps aligned to define said top finger handle and said thumb handle.

3. The container of claim 2 wherein said top wall includes center flaps within said thumb handle and said top finger handle, said center flaps substantially closing said thumb handle and said top finger handle, said center flaps being adapted to fold down into said container to open said thumb handle and said top finger handle.

4. The container of claim 3 wherein said rear wall includes a center flap within said side finger handle, said side finger handle center flap substantially closing said side finger handle and being adapted to fold into said container to open said side finger handle.

5. The container of claim 4 further comprising a liner, said liner including a rear panel abutting said rear wall, said liner rear panel defining an opening aligned with said side finger handle.

6. A flip-top paperboard container comprising:

a front wall, a rear wall, and opposed side walls, each of said front, rear, and side walls including top end flaps which cooperate to define a top wall and bottom end flaps which cooperate to define a bottom wall;

a tear strip extending partially around said container, said tear strip being removable from said container to divide said container into a main body portion and a lid portion, said lid portion remaining attached to said main body portion along a living hinge;

said top wall defining a top finger handle of sufficient size to accommodate multiple fingers and a thumb handle of sufficient size to accommodate a single thumb, said top finger handle defined by holes defined in each of said top end flaps; and said rear wall defining a side finger handle, said side finger handle being of sufficient size to accommodate multiple fingers, said side finger handle being positioned such that said side finger handle and said thumb handle can be grasped simultaneously by a single hand, whereby a single hand can be used to support said container by said side finger handle and manipulated by said thumb handle.

7. The container of claim 6 wherein said top wall includes a front edge and rear edge, said top finger hole spaced inwardly from and extending parallel to said front edge, said thumb handle positioned between said top finger handle and said rear edge.

8. The container of claim 7 further comprising a liner, said liner including a rear wall defining an opening aligned with said side finger handle.

9. A paperboard blank for a reclosable, flip-top container comprising:

a first major panel having a top edge, a bottom edge, and a pair of opposed side edges, said first major panel defining a side finger handle;

a second major panel having a top edge, a bottom edge, and a pair of opposed side edges, said second major panel adjoined with said first major panel along one of said side edges;

a third major panel having a top edge, a bottom edge, and a pair of opposed side edges, said third major panel adjoined to said second major panel along one of said side edges;

a fourth major panel having a top edge, a bottom edge, and a pair of opposed side edges, said fourth major panel adjoined to said third major panel along one of said side edges; and a glue flap adjoined to said first major panel along one of said side edges;

each of said major panels including a top end flap adjoined along said top edge and a bottom end flap adjoined along said bottom edge, each of said top end flaps including a top finger hole of sufficient dimension to receive multiple fingers and a thumb hole only large enough to receive a single thumb.

10. The blank of claim 9 wherein said thumb holes and said top finger holes of adjacent top end flaps are oriented ninety degrees out of phase of each other, wherein said thumb holes and said top finger holes cooperate to define a single thumb handle and a single top finger handle when said blank is folded into a container.

* * * * *